United States Patent [19]

Bullock

[11] Patent Number: 4,676,389

[45] **Date of Patent: * Jun. 30, 1987**

[54] TAMPER-RESISTANT CONTAINER CLOSURE

[75] Inventor: Joseph J. Bullock, c/o Cap Snap Sea Co. 890 Faulstich Ct., San Jose, Calif. 95112

[73] Assignee: Bankers Trust Company, New York, N.Y.

[ * ] Notice: The portion of the term of this patent subsequent to Nov. 27, 2001 has been disclaimed.

[21] Appl. No.: 652,525

[22] Filed: Sep. 20, 1984

Related U.S. Application Data

[63] Continuation-in-part of Ser. No. 517,666, Jul. 27, 1983, Pat. No. 4,484,687.

[51] Int. Cl.[4] ..... B65D 41/48

[52] U.S. Cl. ..... 215/232; 215/31; 215/256

[58] Field of Search ..... 215/256, 232, 31

[56] References Cited

U.S. PATENT DOCUMENTS

| | | | |
|---|---|---|---|
| 3,338,446 | 8/1967 | Faulstich | 215/256 X |
| 3,499,567 | 3/1970 | Spotts | 215/31 |
| 3,861,549 | 1/1975 | Watson et al. | 215/232 |
| 4,037,746 | 7/1977 | Ver Hage | 215/31 |
| 4,162,736 | 7/1979 | Faulstich | 215/256 |
| 4,166,552 | 9/1979 | Faulstich | 215/256 |
| 4,437,593 | 3/1984 | Bullock | 215/256 X |
| 4,438,857 | 3/1984 | Bullock | 215/256 |
| 4,484,687 | 11/1984 | Bullock | 215/256 |

*Primary Examiner*—Donald F. Norton
*Attorney, Agent, or Firm*—Julian Caplan

[57] ABSTRACT

A tamper-resistant plastic cap and container neck are disclosed, the cap having a skirt with upper and lower internal beads separated by a circumferential first score line connected to a second score line extending to the lower edge of the skirt. The neck has external beads matching the skirt beads to hold the cap on the neck. By pulling upward on a tab depending from said lower edge adjacent said second score line, the lower part of the skirt may be torn away along the second and then the first score line. This leaves a reclosure cap held on the neck by the upper bead means. A thin flange projecting from the periphery of the cap is used to remove the cap in its reclosure mode. However, this flange is shaped with its underside slanting down-inward to merge with the exterior of the skirt. If one attempts to use the flange to pry off the cap in its original sealing mode, sufficient force cannot be applied. Various cap bead shapes are disclosed. The beads may be continuous or interrupted and closer together and thinner than in prior caps. The skirt and neck below and lower bead are elongated and fit tightly together throughout substantially their entire length to frictionally engage to prevent removal of the cap in sealing mode. In one form of the invention the neck may be sealed with commercially available foil; the cap is dimensioned so the foil is inserted in the cap prior to being applied to the neck.

15 Claims, 15 Drawing Figures

TAMPER-RESISTANT CONTAINER CLOSURE

BACKGROUND OF THE INVENTION

This application is a continuation-in-part of copending application Ser. No. 517,666, filed July 27, 1983, now U.S. Pat. No. 4,484,687.

More particularly, the invention is an improvement upon U.S. Pat. No. 4,166,552 and other prior patents of the assignee of this application.

FIELD OF THE INVENTION

The present invention relates to plastic caps which snap onto the necks of thin-walled plastic containers characterized by the fact that they are tamper-resistant. Thus, in order to withdraw the cap from the neck, it is necessary for the consumer to tear a portion of the skirt off the cap. The remainder of the cap comprises a reclosure cap which may be used repeatedly until the contents of the container are dispensed. The container neck is of a structure which is complementary to the cap, so that the combination of cap and container neck is liquid tight and tamper-resistant.

DESCRIPTION OF THE PRIOR ART

Cap and neck constructions of this general type are shown in U.S. Pat. No. 3,338,446 and, more recently, in U.S. Pat. No. 4,202,455. In each of these, complementary beads on the interior of the outer skirt of the cap snap into grooves on the container neck. In the latter patent, the beads are interrupted. A circumferential scoreline is located in the outer skirt intermediate the beads and a second scoreline extends down from the circumferential scoreline to the bottom edge of the skirt. A tear tab on the bottom of the skirt may be gripped and torn upward, causing the cap to tear on the second scoreline and thence around the circumferential scoreline.

To prevent dishonest patrons from prying the cap off by inserting the fingernails under the bottom edge of the cap, a horizontal shoulder is formed on the necks immediately below the bottom edge of the skirt such, for example, as shown in U.S. Pat. No. 4,438,857.

Container necks have also been provided with an outwardly bulging ring which is engaged by automatic filling, capping and loading machinery to lift the filled container and load the same into a box.

The shoulder below the bottom edge of the skirt may constitute outward protrusions of the neck of the container separated by narrow gaps distributed around the circumference of the shoulder to inhibit the use of the fingernails or conventional prying instruments to remove the cap from the neck before the outer skirt has been torn away.

Further, the bumper ring may be made interrupted rather than continuous, the gaps between the interrupted segments of the bumper ring affording strength resisting tendency of the neck to collapse when pressure is applied to seat the cap on the neck.

In order to remove the upper portion of the cap, in its reclosure phase, and also to increase the area available for information such as the name of the seller, a trademark and a listing of the ingredients of the contents of the container, caps have been provided with peripheral flanges.

The present invention comprises improvements on all of the foregoing features of the prior art.

OBJECTS OF THE INVENTION

The primary object of the present invention is to augment the tamper-proof characteristics of the prior art cap and neck constructions. As hereinafter set forth in detail, among the features of the invention which accomplish this objective are the following:

A foil seal may be applied to the lip of the neck of the container and secured thereto by inductive heating or other means. As set forth in said application Ser. No. 517,666, such a seal may be initially installed in the inside of the cap and held therein prior to application of the cap to the neck by the internal beads of the skirt of the cap. The present invention discloses in part improved internal bead constructions which retain the seal in place more effectively so that the possibility of a container not being sealed with foil is reduced.

Another feature of the invention is a lengthening of the skirt of the cap and a lengthening of a vertical wall of the neck so that tight engagement of the interior of the skirt of the neck wall inhibits removal of the cap (prior to tearing the skirt thereof) by reason of the increased friction.

A further feature of the invention is the fact that the neck is formed with a shoulder below the bottom edge of the skirt, which shoulder is interrupted so as to inhibit the fingernails or a prying instrument being used to pull the cap off the neck without tearing the neck and providing evidence of tampering.

Although an interrupted shoulder of this type has been used heretofore, the use of such a feature with the improved cap and neck structure hereinafter described, including the lengthened skirt, peripheral reclosure cap flanges and cooperating beads and grooves on the cap and neck augment this feature.

Additionally, the interrupted bumper ring, although used with other cap and neck structures, is particularly effective with the features of the invention hereinafter described in detail, including, by way of example, the bead structures on the interior of the cap skirt and the grooves on the container neck, which mate therewith, all of which facilitate seating the cap on the neck without collapsing or crushing the neck.

Various flanges have been used on the reclosure cap to permit the user to pry off the reclosure cap; however, it is important that the flange not be capable of use to pry the entire cap off the neck prior to tearing of the cap skirt. One prior alternative has been to make the flange flexible, as shown in U.S. Pat. No. 4,166,552. In accordance with present invention, means are provided to inhibit the fingernails from being used to pry the flange upward. In one form of the invention, the underside of the flange is slanted downwardly-inwardly at an angle of about 45°. The slanted portion may terminate at the upper edge of the flange, or there may be a thin, relatively vertical surface at the extreme periphery of the flange. Additionally, the flange may be weakened interiorly so that, if an attempt is made to pry it off, the flange tears.

Another feature of the invention relates to the shapes of the upper and lower beads on the interior of the cap skirt. Such beads may be made thinner and continuous rather than interrupted and yet achieve the advantages of interrupted beds in that they permit the cap to distort outwardly during the capping procedure without likelihood of collapsing the neck. An advantage of thinner beads which are continuous is that the foil is retained within the cap more effectively and there is little possibility of the container being capped without the seal being in place.

Other bead features of the present invention are described hereinafter. An important alternative feature is the staggering of the bead sections in such manner that the sections of the upper bead overlap the gaps between the bead sections of the lower bead. Alternatively, the sections of the upper and lower beads may be of approximately the same length and approximately in line, rather than staggered.

The cap of the present invention may be used with a foil seal liner as heretofore explained. However, alternatively, an inner skirt which seals against the inside of the container neck may be used and many of the features heretofore described are also applicable with caps having such inner skirt construction. The inner skirt prevents use of the invention with a foil closure on the rim of the neck. Such foil seal is particularly useful with containers for pharmaceuticals since they provide an additional indicator of tampering. On the other hand, liquid and some solid products are not so sensitive to tampering and the use of an inner skirt or plug is particularly desirable with such caps and cap-container neck combinations.

SUMMARY OF THE INVENTION

The invention of the present application is described inferentially in the objects of the invention heretofore set forth. Features reside in the use of a foil seal which is installed in the cap prior to the cap being applied to the container neck and, when the cap is thus applied, comes in intimate contact with the rim of the container neck so that it may be sealed thereto by inductive heating or other means. The use of continuous, or at least longer upper bead sections, more effectively retains the foil seal in place in the interval between its installation and its application to the container neck. The shapes of the top and bottom beads hereinafter described are more effective in preventing crushing or collapsing of the container neck during capping and also permit prying the reclosure cap off the neck with less effort then heretofore. Prying a reclosure cap off may be of importance in the pharmaceutical industry where arthritis or other ailments inhibit the user from removing a prior art reclosure cap. The staggering of the top and bottom bead sections hereinafter described facilitates capping the cap without the danger of collapsing the container neck.

In one form of the invention, the skirt of the cap is elongated and the interior thereof fits with a friction fit against the exterior of an elongated vertical neck surface. This inhibits prying the cap off the container without tearing the neck. Further to prevent prying the cap off the neck, the flange which extends peripherally from the top of the cap is shaped and constructed in such manner that the fingernails cannot be used to pull the cap off prior to the skirt being torn. A shoulder is provided upon which the lower edge of the cap rests. To prevent a prying instrument being inserted under the lower edge of the skirt, the shoulder is made interrupted—i.e., protrusions separated by gaps, the width of the gaps being insufficient to permit the entry of the fingernails or a conventional prying instrument. The shoulder merges into a vertical surface which has a "bumper ring" series of interrupted protrusions. The bumper ring is used to grip the cap during filling, capping and loading into a container. Interrupting the bumper ring with straight sections gives strength to the neck to resist collapse when force is applied to seat the cap on the neck.

Other objects of the present invention will become apparent upon reading the following specification and referring to the accompanying drawings in which similar characters of reference represent corresponding parts in each of the several views.

BRIEF DESCRIPTION OF THE INVENTION

Figure 1:
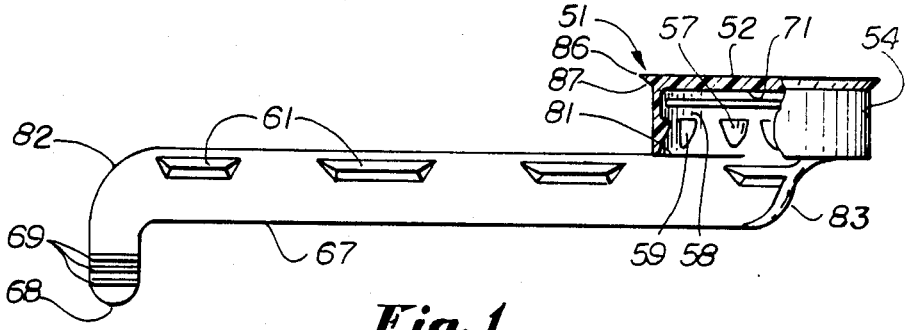
FIG. 1 is an elevational view of one modification of the cap of the present invention, being partially broken away in section and with the bottom part of the skirt being extended and developed in the plane of the drawing.

In FIGS. 1–3, 6 and 7 is shown one form of container neck with which the present invention may be used. Neck 11, therefore, has a thin inward extending horizontal top flange 12 which terminates in a substantially vertical inner edge 13. Below edge 13 of flange 12 is a substantially horizontally outwardly extending surface 14 which terminates in a top internal groove 16. Below groove 16, the inside wall of the neck 11 slants downwardly-outwardly in a surface 17 terminating in a vertical wall 18. Below wall 18 is a second internal groove 21 and below the groove 21 is another vertical wall 23 which terminates in a outwardly-downwardly slanted wall 24 which, in turn, terminates in an internal vertical wall 25. The internal structure of the neck 11 is subject to considerable variation.

Directing attention next to the exterior of the neck 11, the top corner 26 where flange 12 originates is slightly rounded and merges into top external vertical wall 27, There is a slightly inwardly directed shoulder 28 at the lower edge of wall 27 which continues inward and merges into groove 29 which is of lesser diameter than wall 27. Below groove 29 is a downwardly-outwardly slanted wall 31 which comprises the top surface of external locking bead 32. The lower edge of bead 32 comprises a shoulder 33. Below shoulder 33 is a second external vertical wall 34 which is of lesser diameter than groove 29. Below wall 34 is an outward slanted wall 36 which terminates in third external elongated vertical wall 37 which has a diameter greater than wall 27.

At the bottom of surface 37 is an interrupted shoulder 41. Said shoulder 41 consists of a plurality of circumferentially spaced protrusions 42, the outer edges 43 of which are rounded, separated by gaps 44. The width of the gaps 44 are insufficient to permit the fingernails or a prying instrument from being inserted under the lower edge 67 of the cap skirt 54 to pry the skirt off prior to tearing thereof. In a preferred embodiment, the protuberances 42 extend outwardly approximately 0.065 inches and are of a height approximately 0.037 inches for a shoulder area where the outside diameter of the protuberances is 1.500 inches.

Shoulder 41 merges with a short vertical 46, which is provided with interrupted bumper ring 47. As illustrated, there are four circumferentially spaced apart outward bulging bumper ring sections 48 having approximately semicircular cross-section inner and outer surfaces. The areas 49 between the outward bulging sections provide strength resisting collapse of the bumper ring during application of pressure during the seating of the cap 51 on the neck 11. The bumper ring 47 is used in certain types of filling, capping and loading equipment whereby grippers lift a container and deposit it in a box pallet. The bumper ring 47 also prevents the grippers from contacting the cap 51 and thus reduce the chance of the cap being pulled off the neck. The shape of the exterior as well as the interior of the neck 11 are subject to variation.

Directing attention now to cap 51, again the structure of the cap is subject to variation and in its general principles resembles the commercially highly successful cap of assignee's licensee. In the preferred embodiment shown in FIG. 1, cap 51 has a preferably flat top disc 52 on which a label or printed matter may be applied. The bottom 53 of disc 52 is also preferably flat. Depending from disc 52 is a cap skirt 50 having an external wall 54. In the preferred embodiment of the wall 54, the surface is smooth and substantially vertical and is elongated. The inside surface of the cap skirt 50 has a top internal vertical wall 56. Top locking bead means 57 are provided on the interior of the skirt 50 below the wall 56 positioned to lock under the shoulder 28 in the assembled condition of the cap and the neck. Upper bead means 57 may be continuous (see FIG. 1A) or, as shown in FIG. 1, may be interrupted. The interrupted bead sections have substantially horizontal top surfaces 58 and downwardly slanted surfaces 59 which terminate slightly above scoreline 81.

Second or lower bead sections 61 may be provided. Again, bead sections may be continuous as shown in the bead **61*a* in FIG. 1A or interrupted as shown in FIG. 1. The interrupted bead sections 61 of FIG. 1 are longer than the upper sections 57. The top surface 63 is slanted downward inwardly at a fairly acute angle. The lower surface 64** slants downwardly outwardly.

Below the bead sections 61 is a third vertical wall 66 which extends down to the bottom edge 67 of the skirt 50. At one location along the bottom edge 67 there is a depending tear tab 68 which may have gripper ridges 69 on its interior surface. Skirt wall 66 is elongated and fits tightly against surface 37, the friction between the two inhibiting pulling the cap 51 off the neck 11 until the skirt 50 is torn. The slanted surfaces 59 and 64 facilitate cap 51 sliding over corner 26 and surface 61 without splitting the skirt.

Figure 1A:
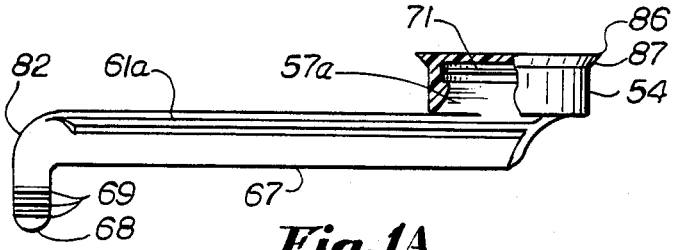
FIG. 1A is a view in reduced scale similar to FIG. 1 of a modification.
Figure 6:
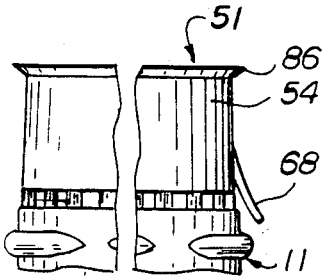
FIG. 6 is an elevational view of the upper portion of a container neck and cap, the cap being in seated position.

In FIG. 1 the upper bead 57, as well as the lower bead 61, are shown interrupted, thereby enabling the skirt to expand more readily than if a continuous bead were used. In FIG. 1A, however, the beads **57*a*, 61*a* are continuous. Thinner continuous beads permit the cap to expand more readily than solid thick continuous beads. The continuous top bead 57*a* of FIG. 1A is particularly advantageous since it tends to retain the foil disc 71 inside the cap during the interval between the time the seal 71** is inserted and the cap is applied to the container neck. This reduces the possibility of a cap being applied without any foil seal therein.

Spaced between lower bead means 61 and upper bead means 58 is an internal scoreline 81. Extending upward from the bottom edge 67 of the cap 51 in immediate proximity to the tear tab 68 is a curved or slanted scoreline 82 which merges with the scoreline 81. The scoreline 82 curves upwardly and to the right from the left side of the tab 68. However, the line 82 might also curve upwardly and to the left of the right edge of the tab 68. A thickening 83 of the wall 54 adjacent line 82 prevents tearing off the tab 68, particularly if the user pulls the tab in the wrong direction.

Figure 2:
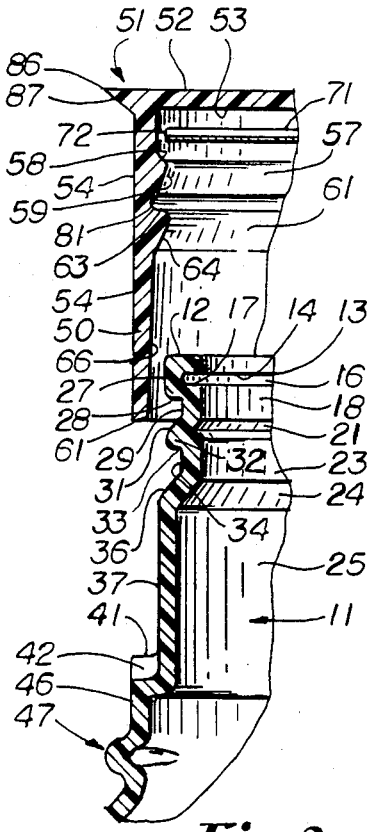
FIG. 2 is an enlarged, exploded, fragmentary sectional view of a portion of the structure of FIG. 1 and a portion of a container neck, prior to the cap being applied.
Figure 7:
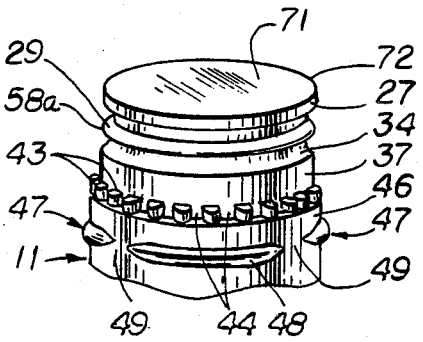
FIG. 7 is a perspective view of the container neck with the cap removed.

A particular feature and advantage of the present invention is that, prior to the cap 51 being applied to the neck 11, a foil sealing disc 71 of a commercially available type is applied to the underside 53 of the top cap disc 52. The bead sections 57 assist in keeping the disc 71 in place prior to the cap being installed. When the cap is installed, as best shown in FIG. 2, the seal 71 seats on the flange 12. Rounded outer edge 72 fits over the rounded corner 26. Adhesives or heatng means cause the disc 71 to adhere to the flange 12. If an attempt is made to tamper with the contents of the container, such tampering can usually be detected by examination of the condition of the disc 71.

Figure 5:
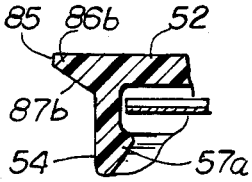
FIGS. 4 and 5 are fragmentary enlarged sectional views showing modified flange structures.
Figure 4:
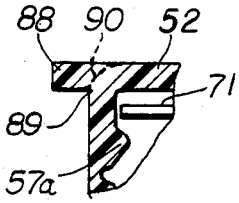

As shown in FIG. 1, a horizontal peripheral flange 86 projects out from the disc 52 at the upper end of the wall 54. The underside 87 slants upwardly-outwardly at an angles of about 45°. Thus, it is difficult for one to pry the cap off the neck 11 while the skirt 50 is intact. In FIG. 5 is shown a thin vertical edge 85 at the outer edge of slanted surface **87*b*. An alternate structure is shown in FIG. 4 where the flange 88 is rectangular in cross-section and there is a sharp corner 89 where the underside of the flange 88 intersects the wall 54. If an attempt is made to pry upward on the flange 88 while the skirt is intact, because of the sharp corner 89, the flange tears approximately along the line 90**. This prevents removing the cap, but also indicates that an attempt has been made to tamper with the contents.

Figure 3:
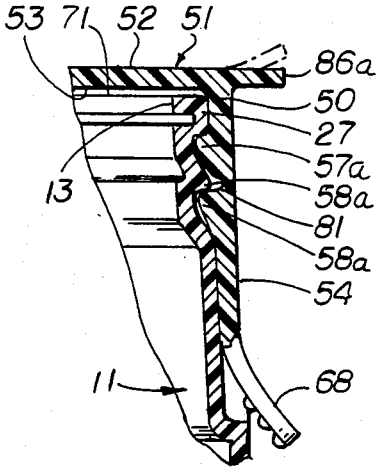
FIG. 3 is a view similar to FIG. 2 showing the cap applied to the container neck.

An additional tamper-resistant feature is shown in FIG. 3. Thus, the bottom edge 67 of the 50 skirt of the cap fits tightly against the shoulder 41. It is difficult, or impossible, for one to get one's fingernails under the edge 67 to pry the cap off while the skirt is intact. In the region where the tear tab 68 extends down below the lower edge 67, the cap flexes sufficiently so that the tab bends outwardly. It is relatively easy for the patron to grip the tear tab 68 when it extends outwardly away from the container neck, If the tear tab 68 were to lie flat against a vertical surface of the neck, then it would be necessary to pry the tab 68 outward either with the fingernails or an implement.

Figure 8:
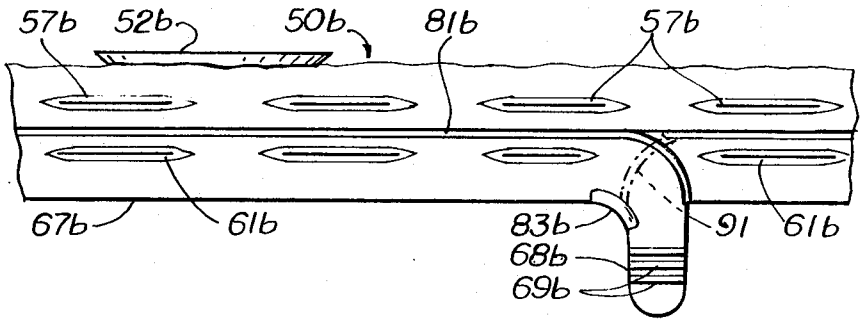
FIG. 8 is a schematic view showing the skirt of a cap developed in a plane.

FIGS. 8—13 are schematic views showing the interior of the cap skirt developed in a flat plane. In FIG. 8, both the upper beads and lower beads are interrupted. The upper bead sections **57*b* are in line with the lower bead sections 61*b* and both sections are of approximately the same length, although it is preferable that the upper sections 57*b* be slightly shorter than the lower sections 61b. This construction facilitates stretching of the skirt 50b during capping action. The bead sections are elongated—i.e., the upper bead sections 57b are considerably longer than the upper sections 57 of FIG. 1. Another feature of FIG. 8 is shown by dotted line 91. Although the scoreline 82b may curve upward to the left, alternatively the scoreline 82b** may curve upwardly and to the right.

FIG. 1A shows a modification wherein both the upper bead sections 57a and the lower bead sections 58a, are continuous rather than interrupted as shown in FIGS. 1 and 8. It is preferable that the thickness of beads 57a and 61a be less than the beads 57 and 61 of FIG. 1 to permit expansion of the skirt during the capping operation.

Figure 9:
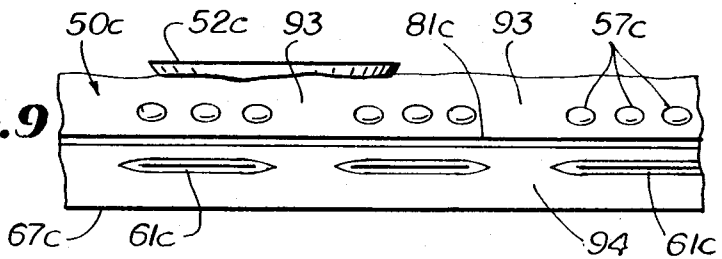
FIGS. 9–13 are fragmentary views of portions of modifications of the structure of FIG. 8.

FIG. 9 shows a structure similar to FIG. 8, except that the upper bead consists of a plurality of small upper bead sections 57c grouped with gaps therebetween, which gaps coincide with the gaps between the lower bead sections 61c. Thus, there may be three (or more or less) short upper bead sections 57c, the total length of which approximates the length of a lower bead section 61c and the gaps 93 between groups of upper bead sections is approximately equal to the gaps 94 between lower bead sections.

Figure 10:
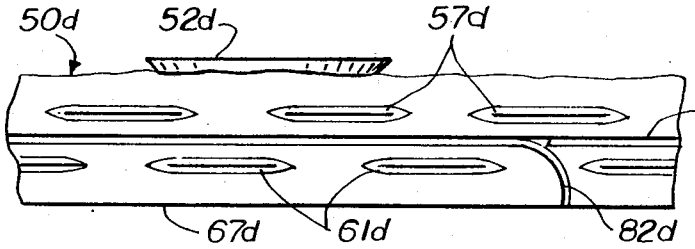

FIG. 10 is a further modification of the structure of FIG. 8, wherein, instead of the upper and lower bead sections being in line, as in FIG. 8, the upper bead sections 57d are staggered relative to the lower bead sections 61d. The staggering of the sections prevents the cap from splitting if such a tendency develops because a vertical splitting of the cap will be prevented either by the lower bead sections 61d or, if it occurs in the gap between lower bead sections, by the upper bead section 57d immediately thereabove.

Figure 11:
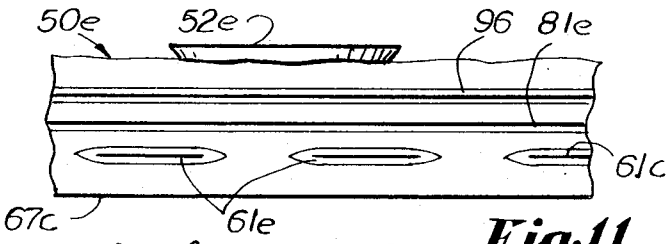

FIG. 11 is a further modification of the structures of FIGS. 8 and 10 wherein the upper bead 96 is continuous and thin and the lower bead is interrupted in sections separated by gaps. This structure has the advantage of FIG. 10 in stopping splitting of the skirt, but has the additional advantage of the uninterrupted upper bead of FIG. 1A.

Figure 12:
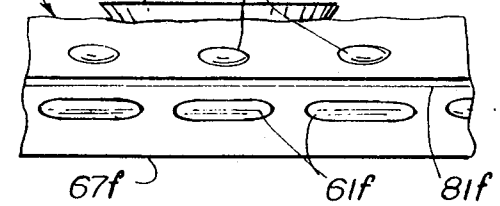
Figure 13:
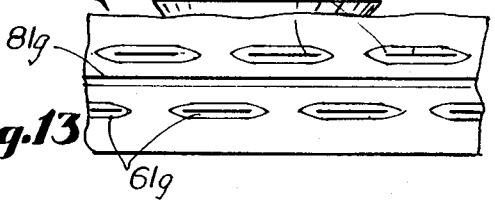

FIG. 12 shows short interrupted upper bead sections 57f separated by relatively long gaps 93f and short lower bead sections 61f which are somewhat longer than the upper bead section, but comparatively shorter than the lower bead sections of FIGS. 1 and 8–11. In FIG. 12, the upper and lower bead sections 57f, 61f are vertically aligned. In FIG. 13, the upper bead sections 57g are shown staggered relative to lower bead sections 61g to achieve the advantage of the staggered sections of FIG. 10.

Figure 14:
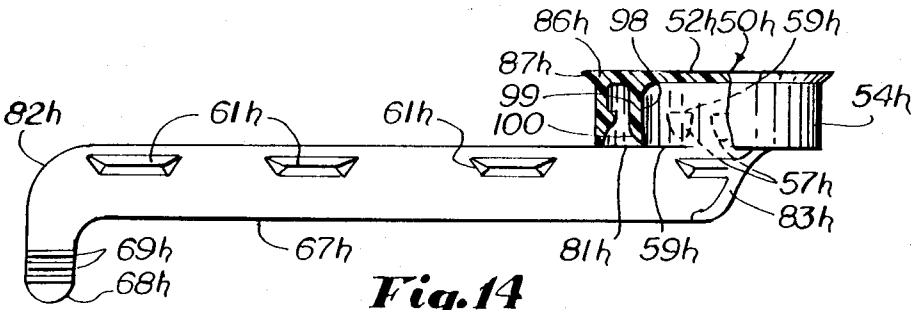
FIG. 14 is a view similar to FIG. 1 showing a cap provided with an inner skirt, it being understood that the other modifications of the invention may be used with inner skirts as well.

In the modifications heretofore illustrated and described, the cap 51 is intended for use with a neck 11 which is closed by a foil or other seal 71, a structure particularly useful in packaging pharmaceuticals, such as tablets. The foil seal 71 may be inspected by the user to determine whether there has been tampering with the contents. However, in many usages, a seal 71 is unnecessary. In such usages, an inner skirt such as that shown in U.S. Pat. Nos. 3,338,446, 4,202,455 and several other patents of the assignee of this application may be used, the outer wall 99 of the inner skirt 98 sealing against the surfaces 13, 18 and 23 of the inner wall of the container neck 11. Thus, as shown in FIG. 14, the cap 51h is similar to the cap of FIG. 1, except that the foil seal 71 is eliminated and an inner skirt 98 having an outer surface 99 dimensioned to fit tightly against surfaces 13, 18 and 23 as provided. Preferably, the lower edge 100 of the inner skirt 98 is tapered to facilitate capping. Any of the bead constructions shown in FIGS. 1, 1A and 8 to 12, inclusive, may be used with a cap having inner skirt 98.

In many respects the structures of FIGS. 1, 1A and 8 to 13 resemble each other and the same reference numerals followed by subscripts a to h, respectively, designate corresponding parts.

What is claimed is:

1. In combination, a plastic cap and a container neck said cap comprising a top disc having a depending skirt, said skirt having first bead means extending around the inside of said skirt spaced downward from said disc, second bead means extending around the inside of said skirt spaced downward from said first bead means, a first scoreline extending circumferentially around said skirt spaced between said first and second bead means, a second scoreline extending up from the bottom edge of said skirt and merging with said first scoreline, tear means on said bottom edge adjacent said second scoreline, whereby by pulling said tear means the bottom of said skirt may be torn off by tearing upward along said second scoreline and then around said first scoreline, said cap having an elongated vertical cap wall below said second bead means, said container neck comprising a top neck finish, external third and fourth bead means on the exterior of said neck in a position to engage said first and second bead means, an elongated vertical neck wall below said fourth bead means, said cap wall and said neck wall fitting tightly together throughout substantially the entire length of said elongated vertical neck from a point closely adjacent said fourth bead means and frictionally engaging to prevent removal of said cap from said neck without tearing off the lower part of said skirt.

2. A combination according to claim 1 which further comprises a seal disc beneath said top disc inside said skirt and above said first bead means, whereby when said cap is applied to said neck said seal disc fits tightly against said top finish and is sealable with said top finish so that access to said neck cannot be obtained without tearing open said seal disc, said first means retaining said seal disc within said cap prior to installation of said cap on said neck.

3. A combination according to claim 2 in which said seal disc is foil and adheres to said neck finish upon being heated.

4. A combination according to claim 2 which further comprises an external shoulder positioned to fit tightly under the lower edge of said skirt to impede attempts to pry the lower edge of said skirt upward, the width of said shoulder being approximately equal to the thickness of said skirt.

5. A combination according to claim 1 in which said first bead means is interrupted and comprises a plurality of first bead sections separated by a plurality of first bead gaps and said second bead means is interrupted and comprises a plurality of second bead sections separated by a plurality of second bead gaps, said first bead means and said second bead means being substantially co-extensive in length, said first bead sections being vertically aligned with said second bead sections and said first bead gaps and said second bead gaps being substantially co-extensive in length.

6. A combination according to claim 1 in which said first bead means is interrupted in first bead sections separated by first bead gaps and said second bead means is continuous.

7. A combination according to claim 1 in which said cap further comprises a second skirt depending from said disc positioned to seal against the inside of said neck.

8. A combination according to claim 1 in which said first bead means is interrupted and comprises a plurality of first bead sections separated by a plurality of first bead gaps and said second bead means is interrupted and comprises a plurality of second bead sections separated by a plurality of second bead gaps, said first and second bead sections being staggered so that said first bead sections are vertically aligned with said second bead gaps.

9. A plastic cap for sealing a container neck comprising a top disc having a depending skirt, said skirt having first bead means extending around the inside of said skirt spaced downward from said disc, second bead means extending around the inside of said skirt spaced downward from said first bead means, a first scoreline extending circumferentially around said skirt spaced between said first and second bead means, a second scoreline extending up from the bottom edge of said skirt and merging with said first scoreline, tear means on said bottom edge adjacent said second score line, whereby by pulling said tear means upward along said second scoreline and then around said first scoreline, the bottom of said skirt may be torn off by tearing upward along said second scoreline and then around said first scoreline, said first and second bead means being engageable with third and fourth bead means, respectively, on the exterior of said neck to prevent removal of said cap without tearing off the portion of said skirt below said first scoreline, said first bead means comprising first bead sections separated by first gaps, said second bead means comprising second bead sections separated by second gaps, said first gaps being vertically aligned with said second gaps, there being no first bead sections aligned with said second gaps, each of said first bead sections comprising a plurality of short subsections.

10. A plastic cap for sealing a container neck comprising a top disc having a depending skirt, said skirt having first bead means extending around the inside of said skirt spaced downward from said disc, second bead means extending around the inside of said skirt spaced downward from said first bead means, a first scoreline extending circumferentially around said skirt spaced between said first and second bead means, a second scoreline extending up from the bottom edge of said skirt and merging with said first scoreline, tear means on said bottom edge adjacent said second score line, whereby by pulling said tear means the bottom of said skirt may be torn off by tearing upward along said second scoreline and then around said first scoreline, said first and second bead means being engageable with third and fourth bead means, respectively, on the exterior of said neck to prevent removal of said cap without tearing off the portion of said skirt below said first scoreline, said first bead means comprising first bead sections separated by first gaps, said second bead means comprising second bead sections separated by second gaps, said first gaps being substantially vertically in line with said second bead sections, there being no first bead sections aligned with said second bead sections.

11. A plastic cap for sealing a container neck having a top finish comprising a top disc having a depending skirt, said skirt having first bead means extending around the inside of said skirt spaced downward from said disc, second bead means extending around the inside of said skirt spaced below said first bead means, a first scoreline extending circumferentially around said skirt spaced between said first and second bead means, a second scoreline extending up from the bottom edge of said skirt and merging with said first scoreline, tear means on said bottom edge adjacent said scoreline, whereby by pulling said tear means the bottom of said skirt may be torn off by tearing upward along said second scoreline and then around said first scoreline, said first and second bead means being engageable with third and fourth bead means, respectively, on the exterior of said neck to prevent removal of said cap without tearing off the portion of said skirt below said first scoreline, a flange around the top of the exterior of said skirt, said flange assisting in removal of said cap when said portion of said skirt below said first scoreline is torn off, the underside of said flange slanting down-inward to merge with the exterior of said skirt.

12. A plastic cap for sealing a container neck having a top finish, said neck having an elongated vertical neck wall adjacent the bottom of said neck, comprising a top disc having a depending skirt, said skirt having first bead means extending around the inside of said skirt spaced downward from said disc, second bead means extending around the inside of said skirt spaced downward from said first bead means, a first scoreline extending circumferentially around said skirt spaced between said first and second bead means, a second scoreline extending up from the bottom edge of said skirt and merging with said first scoreline, tear means on said bottom edge adjacent said second scoreline, whereby by pulling said tear means the bottom of said skirt may be torn off by tearing upward along said second scoreline and then around said first scoreline, said first and second bead means being engageable with third and fourth bead means, respectively, on the exterior of said neck to prevent removal of said cap without tearing off the portion of said skirt below said first scoreline, said skirt having an elongated vertical skirt wall positioned to frictionally engage said elongated vertical neck wall to prevent removal of said cap from said neck without tearing off the lower part of said skirt, a seal disc beneath said top disc inside said skirt and above said first bead means, whereby when said cap is applied to said neck said seal disc fits tightly against said top finish and is sealable with said top finish so that access to said neck cannot be obtained without tearing open said seal disc, said first means retaining said seal disc within said cap prior to installation of said cap on said neck, and a container neck having said external third and fourth bead means on its exterior in a position when engaged with said first and second bead means to force said seal disc into tight engagement with said neck finish, said neck being formed with an external shoulder positioned to fit tightly under the lower edge of said skirt to impede attempts to pry the lower edge of said skirt upward, the width of said shoulder being approximately equal to the thickness of said skirt, said shoulder being formed with a plurality of gaps.

13. A plastic cap for sealing a container neck comprising a top disc having a depending skirt, said skirt having first bead means extending around the inside of said skirt spaced downward from said disc, second bead means extending around the inside of said skirt spaced downward from said first bead means, a first scoreline extending circumferentially around said skirt spaced between said first and second bead means, a second scoreline extending up from the bottom edge of said skirt and merging with said first scoreline, tear means on said bottom edge adjacent said second scoreline, whereby by pulling said tear means the bottom of said skirt may be torn off by tearing upward along said second scoreline and then around said first scoreline, said first and second bead means being engageable with third and fourth bead means, respectively, on the exterior of said neck to prevent removal of said cap without tearing off the portion of said skirt below said first scoreline, said first bead means comprising first bead sections separated by first gaps, said second bead means comprising second bead sections separated by second gaps, said first gaps being substantially vertically in line with said second bead sections, the number of first bead sections being equal to the number of said second bead sections.

14. In combination, a plastic cap and a container neck, said cap comprising a top disc having a depending skirt, said skirt having first bead means extending around the inside of said skirt spaced downward from said disc, second bead means extending around the inside of said skirt spaced downward from said first bead means, a first scoreline extending circumferentially around said skirt spaced between said first and second bead means, a second scoreline extending up from the bottom edge of said skirt and merging with said first scoreline, tear means on said bottom edge adjacent said second scoreline, whereby by pulling said tear means the bottom of said skirt may be torn off by tearing upward along said second scoreline and then around said first scoreline, said cap having an elongated vertical cap wall below said second bead means, said container neck comprising a top neck finish, external third and fourth bead means on the exterior of said neck in a position to engage said first and second bead means, an elongated vertical neck wall below said fourth bead means, said cap wall and said neck wall frictionally engaging to prevent removal of said cap from said neck without tearing off the lower part of said skirt, an external shoulder fitting tightly under the lower edge of said skirt, the width of said shoulder being approximately equal to the thickness of said skirt, said neck slanting downward-outward beyond said shoulder, said external shoulder being formed with a plurality of protrusions separated by a plurality of gaps.

15. A plastic cap for sealing a container neck having a top finish, said neck having an elongated vertical neck wall adjacent the bottom of said neck, comprising a top disc having a depending skirt, said skirt having first bead means extending around the inside of said skirt spaced downward from said disc, second bead means extending around the inside of said skirt spaced downward from said first bead means, a first scoreline extending circumferentially around said skirt spaced between said first and second bead means, a second scoreline extending up from the bottom edge of said skirt and merging with said first scoreline, tear means on said bottom edge adjacent said second scoreline, whereby by pulling said tear means the bottom of said skirt may be torn off by tearing upward along said second scoreline and then around said first scoreline, said first and second bead means being engageable with third and fourth bead means, respectively, on the exterior of said neck to prevent removal of said cap without tearing off the portion of said skirt below said first scoreline, said skirt having an elongated vertical skirt wall positioned to frictionally engage said elongated vertical neck wall to prevent removal of said cap from said neck without tearing off the lower part of said skirt, a peripheral flange around the top of the exterior of said skirt for use in prying off said cap when said portion of said skirt below said first scoreline is torn off, the underside of said flange slanting downward-inward to merge with the exterior of said skirt.

* * * * *